US009881566B2

(12) United States Patent
Watanabe et al.

(10) Patent No.: US 9,881,566 B2
(45) Date of Patent: Jan. 30, 2018

(54) DISPLAY DEVICE, ELECTRONIC APPARATUS, AND CONTROL METHOD FOR DISPLAY DEVICE

(71) Applicant: Sharp Kabushiki Kaisha, Osaka-shi, Osaka (JP)

(72) Inventors: Tatsuo Watanabe, Osaka (JP); Junki Asai, Osaka (JP); Kenji Maeda, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 118 days.

(21) Appl. No.: 15/030,694

(22) PCT Filed: Oct. 21, 2014

(86) PCT No.: PCT/JP2014/077990
§ 371 (c)(1),
(2) Date: Apr. 20, 2016

(87) PCT Pub. No.: WO2015/060312
PCT Pub. Date: Apr. 30, 2015

(65) Prior Publication Data

US 2016/0267857 A1 Sep. 15, 2016

(30) Foreign Application Priority Data

Oct. 25, 2013 (JP) ..... 2013-222665

(51) Int. Cl.
*G09G 3/36* (2006.01)
*G09G 3/20* (2006.01)

(52) U.S. Cl.
CPC ..... *G09G 3/36* (2013.01); *G09G 3/2092* (2013.01); *G09G 3/3614* (2013.01);
(Continued)

(58) Field of Classification Search
CPC .. G09G 3/3614; G09G 3/3648; G09G 3/2092; G09G 3/36; G09G 2320/0247;
(Continued)

(56) References Cited

U.S. PATENT DOCUMENTS 5,576,729 A * 11/1996 Yamazaki ..... G09G 3/3614 345/208
2003/0020699 A1* 1/2003 Nakatani ..... G06F 3/1415 345/204
(Continued)

FOREIGN PATENT DOCUMENTS

JP 2000-221923 A 8/2000
JP 2009-251607 A 10/2009
(Continued)

OTHER PUBLICATIONS

Official Communication issued in International Patent Application No. PCT/JP2014/077990, dated Jan. 27, 2015.

*Primary Examiner* — Christopher E Leiby
(74) *Attorney, Agent, or Firm* — Keating & Bennett, LLP

(57) ABSTRACT

An object of the present invention is to provide a display device which suppresses power consumption as well as displaying an image with excellent quality. A display device (1) in accordance with one aspect of the present invention includes a polarity determining section (35) for determining whether or not a first polarity in a drive vertical period immediately preceding a first term in which an image is not rewritten is the same as a second polarity in a pause vertical period which is a last pause vertical period before the second vertical period, and a refresh control section (34) for providing an additional vertical period in the first term in a case where the first polarity is the same as the second polarity.

12 Claims, 12 Drawing Sheets

EXAMPLE OPERATION 4

(52) U.S. Cl.
CPC ... *G09G 3/3648* (2013.01); *G09G 2320/0247* (2013.01); *G09G 2320/0257* (2013.01); *G09G 2330/021* (2013.01); *G09G 2340/0435* (2013.01)

(58) Field of Classification Search
CPC ..... G09G 2320/0257; G09G 2330/021; G09G 2340/0435
See application file for complete search history.

(56) References Cited

U.S. PATENT DOCUMENTS

| | | | | |
|---|---|---|---|---|
| 2009/0251445 | A1 | 10/2009 | Ito et al. | |
| 2012/0200541 | A1 | 8/2012 | Hung et al. | |
| 2014/0368484 | A1* | 12/2014 | Tanaka | G09G 3/3648 345/208 |
| 2015/0002381 | A1* | 1/2015 | Fujioka | G09G 3/3614 345/87 |
| 2015/0015567 | A1 | 1/2015 | Fujioka et al. | |
| 2015/0228239 | A1* | 8/2015 | Tanaka | G09G 3/3648 345/204 |
| 2015/0243253 | A1* | 8/2015 | Sone | G09G 3/2096 345/209 |
| 2015/0255040 | A1* | 9/2015 | Inada | G09G 3/3611 345/690 |
| 2016/0012787 | A1* | 1/2016 | Takahashi | G09G 3/3614 345/209 |
| 2016/0365049 | A1* | 12/2016 | Uemura | G09G 3/3614 |

FOREIGN PATENT DOCUMENTS

| | | | |
|---|---|---|---|
| JP | 2013-174916 | A | 9/2013 |
| WO | 2013/118686 | A1 | 8/2013 |
| WO | 2014/002607 | A1 | 1/2014 |
| WO | 2014/050327 | A1 | 4/2014 |
| WO | 2014/103912 | A1 | 7/2014 |

* cited by examiner

EXAMPLE OPERATION 1

EXAMPLE OPERATION 2

EXAMPLE OPERATION 3

EXAMPLE OPERATION 4

DISPLAY DEVICE, ELECTRONIC APPARATUS, AND CONTROL METHOD FOR DISPLAY DEVICE

TECHNICAL FIELD

The present invention relates to a display device, an electronic device, and a control method for the display device.

BACKGROUND ART

In recent years, thin, light, and low-power-consumption display devices such as liquid crystal display devices have been remarkably widespread. Typical examples of apparatuses on which to mount such display devices encompass mobile phones, smartphones, laptop PCs (Personal Computers). It is expected that in the future, development and prevalence of electronic paper, which is an even thinner display device than ever, will be rapidly advanced. Under such circumstances, it is a common challenge to reduce power consumption of display devices.

In conventional CG (Continuous Grain) silicon TFT liquid crystal display panels, amorphous silicon TFT liquid crystal display panels, and the like, it is necessary to refresh a screen at 60 Hz. Therefore, for a reduction in electronic power consumption of the conventional liquid crystal display panels, attempts have been made to achieve a refresh rate lower than 60 Hz.

Patent Literature 1 discloses a liquid crystal display configured such that in a case where no stripes are present in an image over a series of frames, the liquid crystal display device (i) determines that the frames have no characteristic that easily induces flicker and then (ii) lowers a refresh rate.

Meanwhile, Patent Literature 2 discloses a liquid crystal display in which a frame-rate conversion is carried out. In this liquid crystal display, polarity conversion is not carried out in a case where an interpolation frame is displayed.

CITATION LIST

Patent Literature

[Patent Literature 1]

Japanese Patent Application Publication, Tokukai, No. 2009-251607 (Publication date: Oct. 29, 2009)

[Patent Literature 2]

Japanese Patent Application Publication, Tokukai, No. 2013-174916 (Publication date: Sep. 5, 2013)

SUMMARY OF INVENTION

Technical Problem

In recent years, there have been realized an oxide semiconductor liquid crystal display panel in which TFTs are each composed of an oxide semiconductor that contains indium (In), gallium (Ga), and zinc (Zn). An amount of leak current of a TFT composed of an oxide semiconductor is small in an off state. Therefore, unlike the cases of conventional liquid crystal panels, it is unnecessary for an oxide semiconductor liquid crystal display panel to refresh a screen at 60 Hz, and consequently, it is possible to lower a refresh rate to approximately 1 Hz. Accordingly, in an oxide semiconductor liquid crystal display panel, such refreshing of a screen can be caused to pause in a term in which an image is not rewritten. This allows for a reduction in electric power consumption.

However, a liquid crystal display panel is AC driven and in AC driving, a pixel polarity is reversed every time a screen is refreshed. The AC driving of the liquid crystal display panel is intended to prevent ghosting. In a case as described above where refreshing of a screen is caused to pause in a term in which an image is not rewritten, the screen is not refreshed at regular intervals. On this account, the liquid crystal display panel may lose a balance between a period in which the pixel polarity is positive and a period in which the pixel polarity is negative, depending on timing of image rewriting of a moving image. Then, such unbalanced periods may result in a flicker which is visible to a user. Patent Literatures 1 and 2 do not assume the above problem to occur.

According to one aspect of the present invention, it is possible to provide a display device capable of suppressing electric power consumption as well as displaying an image with excellent quality.

Solution to Problem

A display device in accordance with one aspect of the present invention is a display device in which a polarity of a data signal written in each pixel is reversed depending on whether or not refreshing of a display screen is performed, the display device including: a refresh control section for setting vertical periods in each of which an image is rewritten, as vertical periods in each of which the refreshing is performed, and providing, in a term in which an image is not rewritten, a vertical period in which the refreshing is caused to pause; and a polarity determining section for determining whether or not a first polarity in a second vertical period in which the refreshing is performed is the same as a second polarity in a third vertical period in which the refreshing is caused to pause, the second vertical period immediately preceding a first term in which an image is not rewritten, the third vertical period being a last period in which the refreshing is caused to pause before the second vertical period, in a case where the first polarity is the same as the second polarity, the refresh control section providing, in the first term, an additional vertical period in which the refreshing is performed by using a polarity opposite to the first polarity.

A control method for a display device, in accordance with one aspect of the present invention, is a method for controlling a display device in which a polarity of a data signal written in each pixel is reversed depending on whether or not refreshing of a display screen is performed, the method including the steps of: performing the refreshing in each of vertical periods in a term in which an image is rewritten; providing, in a term in which an image is not written, a vertical period in which the refreshing is caused to pause; determining whether or not a first polarity in a second vertical period in which the refreshing is performed is the same as a second polarity in a third vertical period in which the refreshing is caused to pause, the second vertical period immediately preceding a first term in which an image is not rewritten, the third vertical period being a last period in which the refreshing is caused to pause before the second vertical period; and in a case where the first polarity is the same as the second polarity, providing, in the first term, an additional vertical period in which the refreshing is performed by using a polarity opposite to the first polarity.

Advantageous Effects of Invention

According to one aspect of the present invention, a too long duration of one pixel polarity in an unbalanced manner is prevented, so that no flicker is visible to a user. This makes it possible not only to maintain a high display quality, but also to reduce power consumption by providing a vertical period in which refreshing of a screen is caused to pause.

DESCRIPTION OF EMBODIMENTS

The following discusses in detail embodiments of the present invention. In a case where a configuration in a specific section (e.g., Embodiment) below is identical with a configuration described in any other preceding section, a description of the configuration may be omitted. Further, for convenience of explanation, a member identical in function with a member described in a preceding section is given a reference sign identical to that of the member in the preceding section, and a description thereof will be omitted as appropriate.

[Embodiment 1]

(Configuration of Display Device 1)

Figure 1:
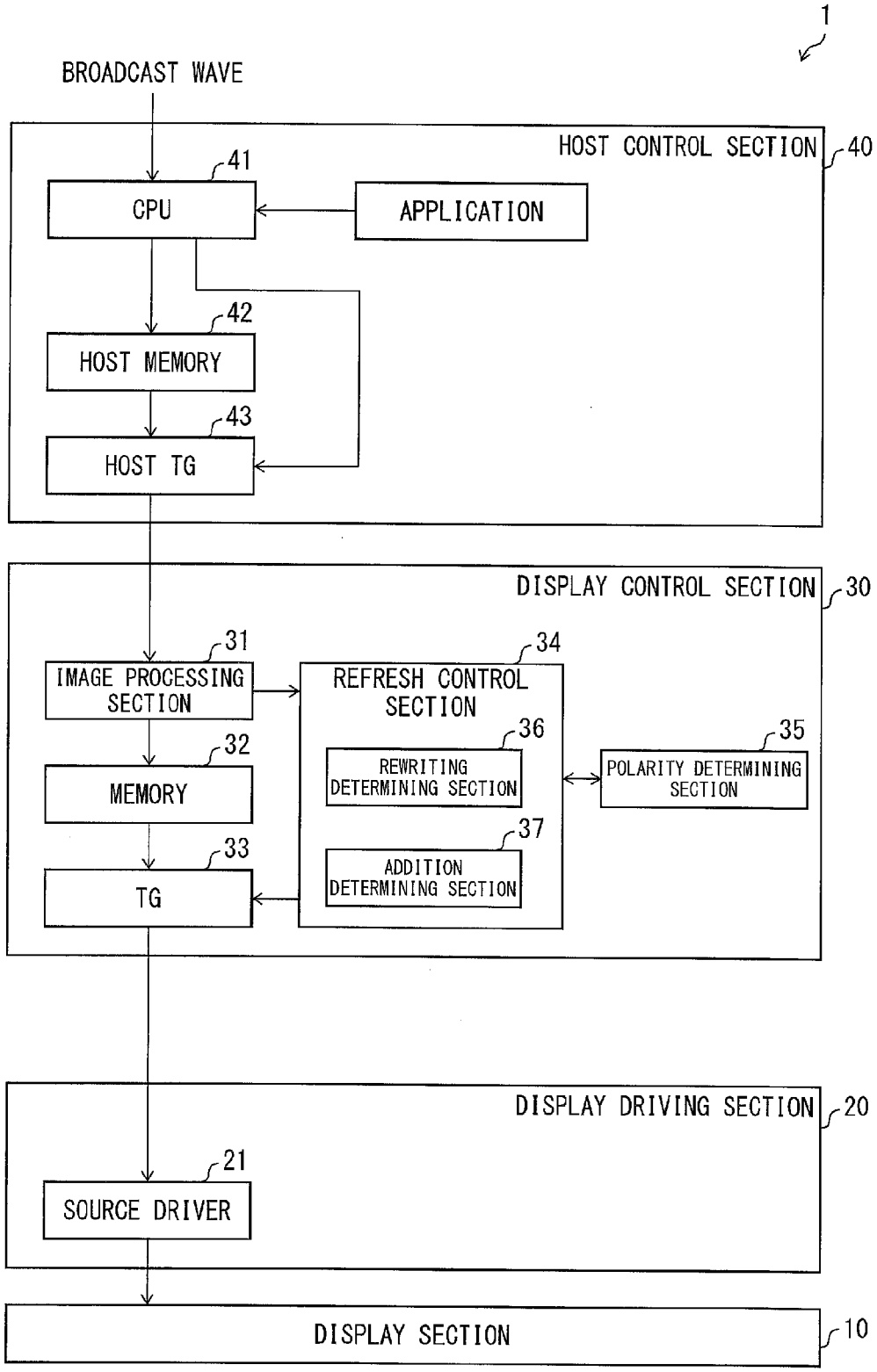
FIG. 1 is a block diagram illustrating a configuration of a display device in accordance with one embodiment.

FIG. 1 is a block diagram illustrating a configuration of a display device 1 in accordance with Embodiment 1. The display device 1 includes a display section 10, a display driving section 20, a display control section 30 and a host control section 40. The display device 1 is a liquid crystal display device. Note that the present invention can be applied not only to liquid crystal display devices but also to any display devices in which polarity reversal is carried out.

The display driving section 20 is a COG (Chip on Glass) driver which is mounted on a glass substrate of the display section 10. This display driving section 20 drives the display section 10. The host control section 40 is a control substrate including a control circuit which is formed on a substrate. This host control section 40 mainly controls a host (electronic apparatus) of the display device 1. The display control section 30 is a control substrate which is provided for processing such as display image processing. The display control section 30 is provided separately from the host control section 40. In Embodiment 1, the display control section 30 determines whether or not to perform refreshing (whether or not to write signals in pixels) in each vertical period. This allows for a reduction in load of the host control section 40, and thereby makes it possible to secure performance of the host control section 40 for carrying out other processing (e.g., processing of an application of the electronic apparatus) in addition to processing for display of an image. The following describes each section in detail.

The display device 1 skips unnecessary refreshing depending on whether or not an image is rewritten. In other words, the display device 1 has varying refresh rates.

(Configuration of Display Section 10)

The display section 10 includes a display screen including a plurality of pixels, and is constituted by, for example, an oxide semiconductor liquid crystal display panel serving as an active matrix liquid crystal display panel. The oxide semiconductor liquid crystal display panel is a liquid crystal display panel in which an oxide semiconductor TFT (thin film transistor) is used as each switching element provided so as to correspond to one or more of a plurality of pixels that are two dimensionally arranged. The oxide semiconductor TFT is a TFT having a semiconductor layer composed of an oxide semiconductor. Examples of the oxide semiconductor encompass an oxide semiconductor (InGaZnO-based oxide semiconductor) in which an oxide of indium, gallium, and zinc is used. In regard to the oxide semiconductor TFT, (i) an amount of electric current flowing in an on state is large and (ii) an amount of leak current in an off state is small. Therefore, by using the oxide semiconductor TFT for a switching element, it is possible not only to increase a pixel aperture ratio but also to reduce a refresh rate of image display to approximately 1 Hz. Reducing the refresh rate allows for such an effect as a reduction in electric power consumption. An increase in a pixel aperture ratio brings about such an effect as causing a display of an image to be brighter. In a case where the brightness of image display is to be set equal to that of a CG (Continuous Grain) silicon liquid crystal display panel or the like, an increased pixel aperture ratio brings about such an effect as reducing electric power consumption by decreasing a light intensity of a backlight.

(Configuration of Host Control Section 40)

The host control section 40 includes a CPU 41(central processing unit), a host memory 42, and a host TG 43 (host timing generator).

The CPU 41 receives image data for use in display on a display screen. The CPU 41 also receives an image rewriting flag (time reference) indicative of timing for displaying the image data. The image data and the image rewriting flag are generated by use of, for example, a running application which has been activated in the display device 1. Alternatively, the image data and the image rewriting flag are contained in data streams received in data streaming via the Internet or in broadcast waves. The image data here refers to data indicative of a one-frame image in a moving image.

The CPU 41 writes the image data thus received in the host memory 42. The CPU also instructs the host TG 43 on timing for rewriting an image, in accordance with the image rewiring flag. The CPU 41 can also generate image data to be displayed in accordance with an instruction made by an application or the like.

The host memory 42 is a storage device configured by a VRAM (Video Random Access Memory) and the like.

When the host TG 43 receives, from the CPU 41, an instruction to rewrite an image, the host TG 43 (i) obtains the display data from the host memory 42 and (ii) transfers the display data to the display control section 30. Only in a case where an image being displayed needs to be rewritten (i.e., only in a case where the content of the image is to be changed), the host TG 43 transfers, to the display control section 30, image data of a frame in which the image is rewritten. The host TG 43 transfers the image data in accordance with data communication specifications of a mobile device, such as MIPI (Mobile Industry Processor Interface). Note that the host TG 43 transfers, to the display control section 30, a sync signal along with the image data.

(Configuration of Display Control Section 30)

The display control section 30 includes an image processing section 31, a memory 32, a TG 33 (timing generator), a refresh control section 34, and a polarity determining section 35.

The image processing section 31 subjects, to image processing such as color adjustment, the image data received from the host control section 40. The image processing section 31 then writes, into the memory 32, the image data which has been subjected to the image processing. On receipt of the image data from the host control section 40, the image processing section 31 notifies the refresh control section 34 that the image will be rewritten.

The memory 32 stores previously written image data until the image data is overwritten (rewritten).

The refresh control section 34 determines whether or not to refresh a display screen in each vertical period. In other words, the refresh control section 34 determines whether or not to write data signals into a plurality of pixels of the display section 10 in each vertical period. The refresh control section 34 includes a rewriting determining section 36 and an addition determining section 37.

The rewriting determining section 36 of the refresh control section 34 sets, as a drive vertical period in which refreshing is performed, each vertical period in a term in which an image is rewritten (the content of an image being displayed is changed). Meanwhile, the rewriting determining section 36 tentatively sets, as a pause vertical period in which refreshing is caused to pause, each vertical period in a term in which an image is not rewritten. Note that whether or not to rewrite an image is determined depending on whether or not the image data is received, or can alternatively be determined in accordance with a notification from the host control section 40 as to whether or not an image will be rewritten.

The polarity determining section 35 determines whether or not a first polarity is the same as a second polarity, on the basis of past drive vertical periods and pause vertical periods which have been set by the refresh control section 34, in a case where a vertical period of interest (current vertical period) is in a term in which an image is not rewritten. The first polarity here is a polarity of a drive vertical period immediately preceding the term in which an image is not rewritten. The second polarity is a polarity of a last pause vertical period preceding the drive vertical period. For example, in a case where more than one drive vertical period successively occurs, the second polarity is a polarity of a pause vertical period immediately preceding the more than one successive drive vertical period. Details of processing of the polarity determining section 35 will be described later. The polarity determining section 35 notifies a determination result to the addition determining section 37 of the refresh control section 34.

In a case where the first polarity is the same as the second polarity, the addition determining section 37 of the refresh control section 34 provides, in the term in which an image is not rewritten, an additional drive vertical period (additional vertical period) in which refreshing is performed by using a polarity opposite to the first polarity. For example, the addition determining section 37 sets, as an additional drive vertical period in which refreshing is performed, an initial vertical period (pause vertical period of interest following a drive vertical period) in the term in which an image is not rewritten. Note that in a case where the first polarity is different from the second polarity, the refresh control section 34 provides no additional drive vertical period in the term in which an image is not rewritten.

The refresh control section 34 notifies whether or not to perform refreshing in each vertical period, to the TG 33 in accordance with the drive vertical period, the additional drive vertical period and the pause vertical period which the refresh control section 34 has set as above.

The TG 33 transfers the image data to the display driving section 20 in accordance with refresh timing (in accordance with timing of a vertical period) of the display section 10, in accordance with the drive vertical period (including the additional drive vertical period) and the pause vertical period which have been set by the refresh control section 34. The TG 33 reads out the image data from the memory 32 and transfers the image data to the display driving section 20 in the drive vertical period in which refreshing is performed. On the other hand, in the pause vertical period in which refreshing is not performed, the TG 33 does not transfer the image data to the display driving section 20. The TG 33 also generates a timing signal for driving the display section 10, and supplies the timing signal to a source driver 21. Note that the TG 33 can use a sync signal which the host TG 43 supplies for generating the timing signal.

In a case where a term in which an image is not rewritten lasts long (e.g., for not less than 0.25 second), the refresh control section 34 can set a drive vertical period for each predetermined period (e.g., period which is not less than 0.25 second) so that data signals written in pixels will be refreshed. This is intended to maintain display quality in a case where a still image is to be displayed for a long time.

(Configuration of Display Driving Section 20)

The display driving section 20 includes the source driver 21. The source driver 21 writes data signals corresponding to the image data in the pixels of the display section 10, in accordance with timing signals. In Embodiment 1, the source driver 21 reverses a polarity of a data signal written in each pixel every time refreshing is performed. The polarity of the data signal (data potential) here is a polarity with reference to a potential of a counter electrode opposed to a pixel electrode. A reverse driving method is not limited to a particular method, but can be, for example, a frame reversal driving method, a column reversal driving method, a line reversal driving method, or a dot reversal driving method.

Suitable examples of the electronic apparatus which is the host including the display device 1 can encompass electronic apparatuses that place importance particularly on portability (electronic apparatuses whose power source is a battery), such as mobile phones, smartphones, notebook-sized PCs (Personal Computers), tablet devices, e-book readers, and PDAs (Personal Digital Assistants).

(Reference Example 1)

Figure 2:
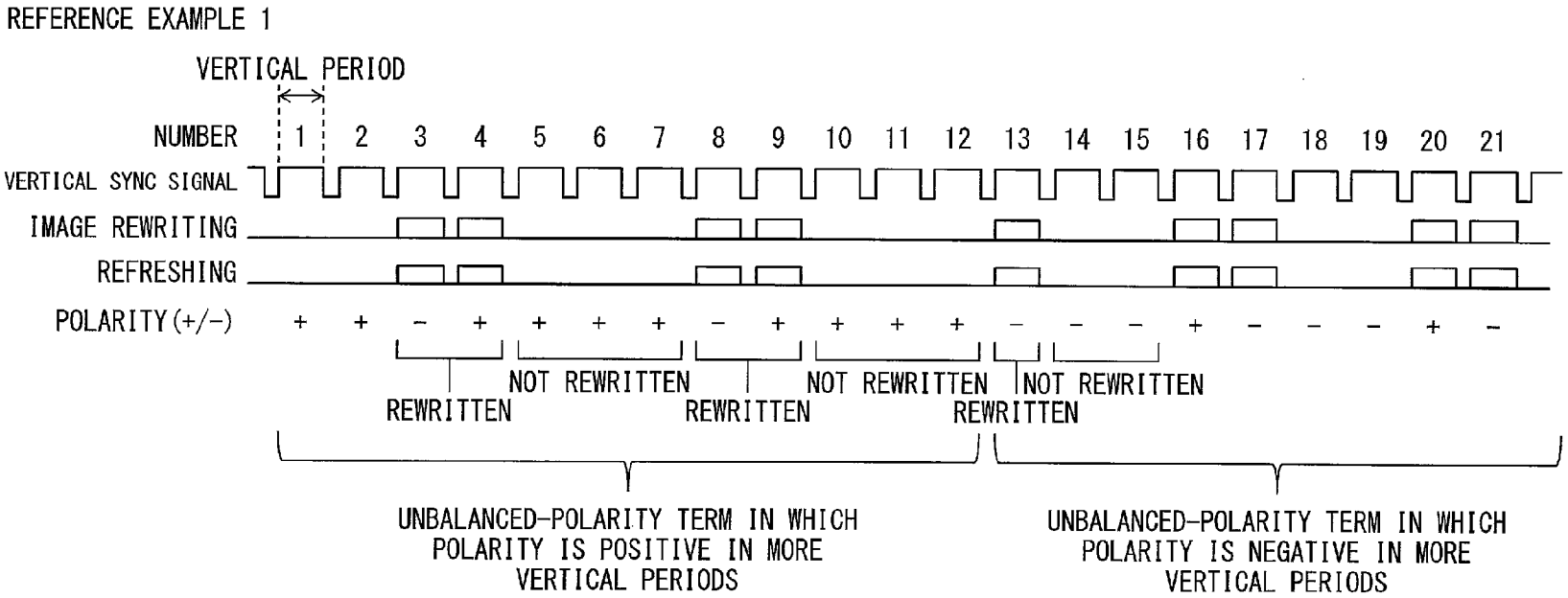
FIG. 2 is a timing chart for image rewriting and refreshing in Reference Example 1.

FIG. 2 is a timing chart for image rewriting and refreshing in Reference Example 1 which is provided for comparison. In FIG. 2, a horizontal axis represents time. Further, in FIG. 2, a vertical sync signal is a signal which defines each vertical period. For convenience, each vertical period in FIG. 2 is numbered. Further, in FIG. 2, rectangles on a line of "image rewriting" indicate that image rewriting is performed in corresponding vertical periods, and rectangles on a line of "refreshing" indicate that refreshing is performed in corresponding vertical periods. Meanwhile, a "polarity" indicates a pixel polarity (polarity of a data signal written in each pixel) in a corresponding vertical period.

In a display device in accordance with Reference Example 1, refreshing (writing of a data signal in each pixel) is performed only in vertical periods in which an image is rewritten, whereas refreshing is not performed in vertical periods in which an image is not rewritten. This makes it possible to reduce power consumption in a term in which an image is not rewritten. Moreover, in Reference Example 1, a polarity of a data signal written in each pixel is reversed every time refreshing is performed.

For example, $1^{st}$ and $2^{nd}$ vertical periods (vertical periods which are numbered 1 and 2, respectively) are a term in which image rewriting and refreshing are not performed. In the $1^{st}$ and $2^{nd}$ vertical periods, the pixel polarity stays positive. In a $3^{rd}$ vertical period, image rewriting and refreshing are performed, and the pixel polarity is reversed to the negative polarity. In a next $4^{th}$ vertical period, image rewriting and refreshing are performed and the pixel polarity is reversed to the positive polarity. Further, $5^{th}$ to $7^{th}$ vertical periods are a term in which image rewriting and refreshing are not performed, and the pixel polarity stays positive. In $8^{th}$ and $9^{th}$ vertical periods, the polarity is reversed twice. Accordingly, the pixel polarity is the same before and after a term including the $8^{th}$ and $9^{th}$ vertical periods.

As described above, in a case where an even number of successive drive vertical periods occur and refreshing accompanied by polarity reversal is performed in each of the even number of successive drive vertical periods, the polarity becomes the same polarity (+) before and after the even number of successive drive vertical periods. In a case where the number of successive drive period is an odd number (including one) like the case of a $13^{th}$ vertical period, the polarity is reversed before and after the odd number of successive drive vertical periods. Since the polarity does not change before and after an even number of successive drive vertical periods, the pixel polarity is out of balance and positive in more vertical periods, for example, in a term from the $1^{st}$ vertical period to the $12^{th}$ vertical period including pause vertical periods and sets of the even number of successive drive vertical periods. Meanwhile, in a term from the $13^{th}$ vertical period in which the polarity is reversed to the negative polarity, the pixel polarity is out of balance and negative in more vertical periods. For example, in a case where a term in which an image is not rewritten lasts longer, an unbalanced-polarity term becomes longer. The unbalanced-polarity term loses a balance in length between positive-polarity vertical periods and negative-polarity vertical periods, and has either one of positive-polarity and negative-polarity vertical periods more than the other. Further, in a case where the number of successive drive vertical periods is always even over a long period of time (several seconds), the unbalanced-polarity term, which loses a balance in length between positive-polarity vertical periods and negative-polarity vertical periods, lasts over the long period of time.

When the positive polarity and the negative polarity each are reversed to the other within a relatively short period of time, no flicker caused by polarity reversal is visible to a user. However, in a case where the unbalanced-polarity term, which loses a balance in length between positive-polarity vertical periods and negative-polarity vertical periods, lasts longer than a certain length of time, a flicker may be viewed by a user when the one polarity is reversed to the other polarity (in and after the $13^{th}$ vertical period in FIG. 2). Further, in a case where the length of a term in which the polarity is positive differs from the length of a term in which the polarity is negative, a flicker tends to be visible to a user. In a display device in which a pause vertical period, in which refreshing is not performed, is provided depending on whether or not an image is rewritten, there may occur a problem that an even number of successive periods in each of which an image is rewritten result in a visible flicker. Timing for rewriting the image varies depending on a moving image to be displayed.

(Reference Example 2)

Figure 3:
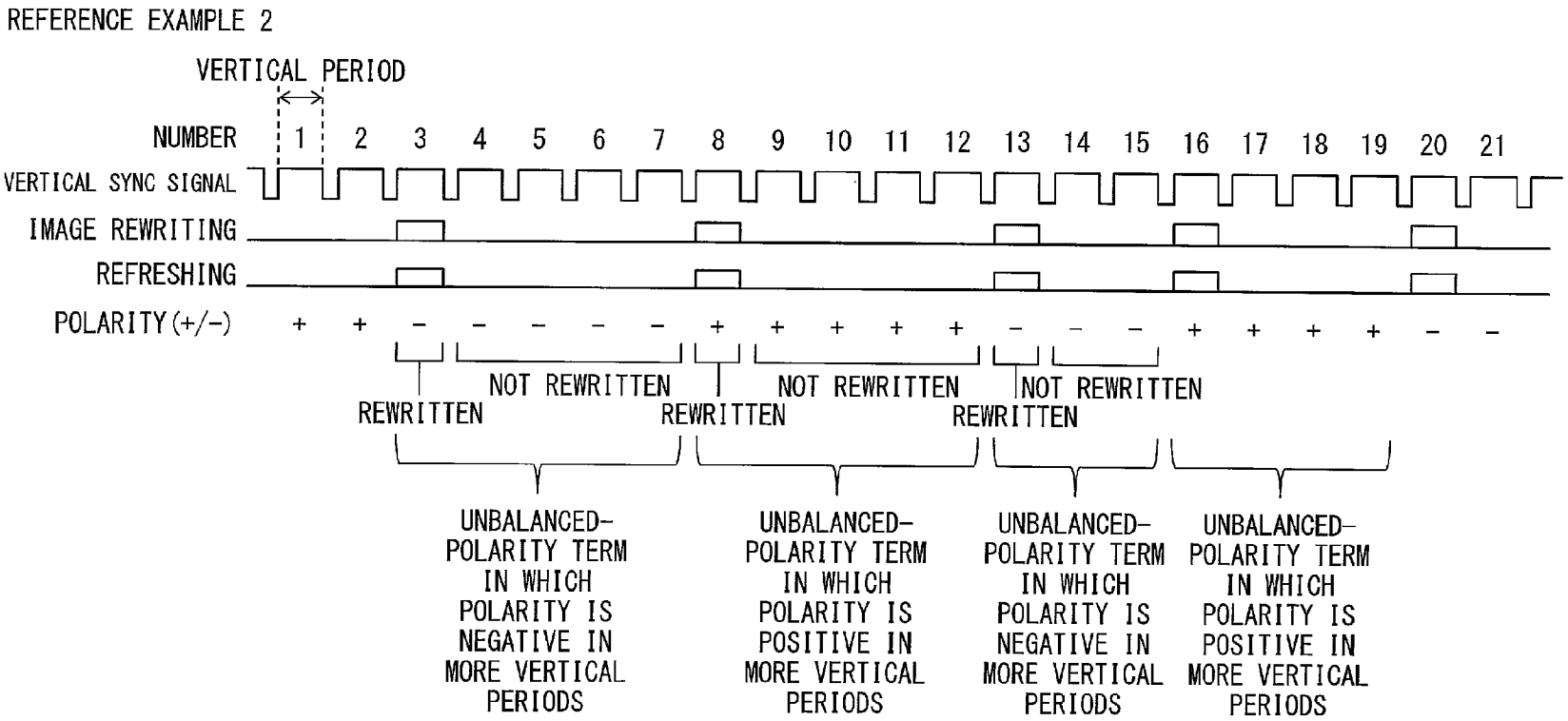
FIG. 3 is a timing chart for image rewriting and refreshing in Reference Example 2.

FIG. 3 is a timing chart for image rewriting and refreshing in Reference Example 2. Respective elements in FIG. 3 indicate the same as those in FIG. 2. Reference Example 2 shown in FIG. 3 is different in timing for image rewiring from Reference Example 1 shown in FIG. 2.

For example, in a case where an image is rewritten as in Reference Example 2, a polarity is reversed in accordance with timing of image rewriting. Accordingly, an unbalanced-polarity term, which loses a balance in length between positive-polarity vertical periods and negative-polarity vertical periods, is shorter than that in Reference Example 1. Therefore, in the case of Reference Example 2, a flicker is hardly visible to a user.

(Example Operation 1)

In order to solve the above problem that a flicker is visible to a user, Embodiment 1 performs additional refreshing in a term in which an image is not rewritten. The following describes an operation of the display device 1 in Embodiment 1.

Figure 4:
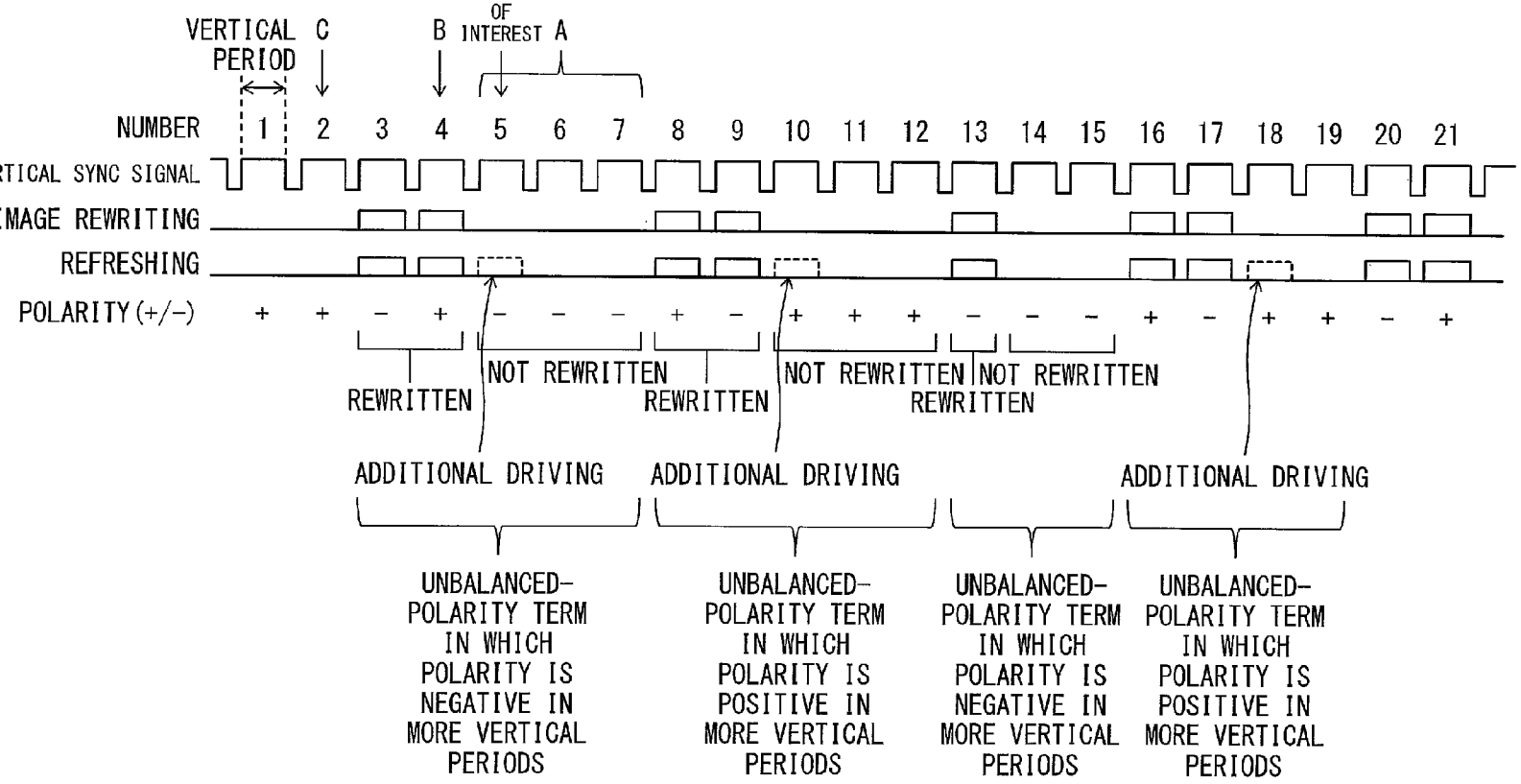
FIG. 4 is a timing chart for image rewriting and refreshing in the display device in accordance with the one embodiment of the present invention.

FIG. 4 is a timing chart for image rewriting and refreshing in the display device 1 in accordance with Embodiment 1. Respective elements in FIG. 4 indicate the same as those in FIG. 2. Note that dotted-line rectangles on a line of "refreshing" indicates refreshing in an additional drive vertical period. Timing for image rewriting in FIG. 4 is the same as that in Reference Example 1 shown in FIG. 2.

The display device 1 performs refreshing in each vertical period in a term in which an image is rewritten. The display device 1 does not perform refreshing in each vertical period in a term in which an image is not rewritten, except for a particular case. That is, in a case where there have occurred an even number of successive drive vertical periods in each of which refreshing is performed and a polarity is reversed before a term in which an image is not rewritten, the display device 1 performs additional refreshing accompanied by polarity reversal in a vertical period in which an image is not rewritten which vertical period is subsequent to the even number of successive drive vertical periods. In other words, in a case where an even number of successive drive vertical periods occur, the display device 1 adds one additional drive vertical period to the even number of successive drive vertical periods so that the number of successive drive vertical periods becomes an odd number.

More specifically, $3^{rd}$ and $4^{th}$ vertical periods are periods in each of which an image is rewritten, and therefore are an even number of successive drive vertical periods. In $1^{st}$ and $2^{nd}$ vertical periods preceding the $3^{rd}$ and $4^{th}$ vertical periods and $5^{th}$ and $7^{th}$ vertical periods following the $3^{rd}$ and $4^{th}$ vertical periods, an image is not rewritten. Then, the display device 1 performs additional refreshing in a vertical period in which an image is not rewritten ($5^{th}$ vertical period) following the even number of successive drive vertical periods ($3^{rd}$ and $4^{th}$ vertical periods). The vertical period in which the additional refreshing is performed is here referred to as an additional drive vertical period. Image data used (data written in a pixel) in the additional drive vertical period ($5^{th}$ vertical period) is the same as image data used in a drive vertical period ($4^{th}$ vertical period) immediately preceding the additional drive vertical period. That is, in the additional drive vertical period ($5^{th}$ vertical period), an image being displayed does not change, but a pixel polarity is reversed. Similarly, a $10^{th}$ vertical period and an $18^{th}$ vertical period, each of which follows an even number of successive drive periods, are set as an additional drive vertical period. In this way, an additional drive vertical period is provided, so that the pixel polarity is reversed before and after successive drive vertical periods ($3^{rd}$ to $5^{th}$ vertical periods). As illustrated in FIG. 4, in a term from the $1^{st}$ vertical period to a $21^{st}$ vertical period, the polarity is reversed before and after an image is rewritten.

This allows the display device 1 of Embodiment 1 to prevent loss of a balance in length between negative-pixel-polarity vertical periods over a long period of time. As a result, the display device 1 is capable of preventing a flicker from being viewed by a user as well as reducing power consumption by providing a pause vertical period.

(Flow of Display Control)

Figure 5:
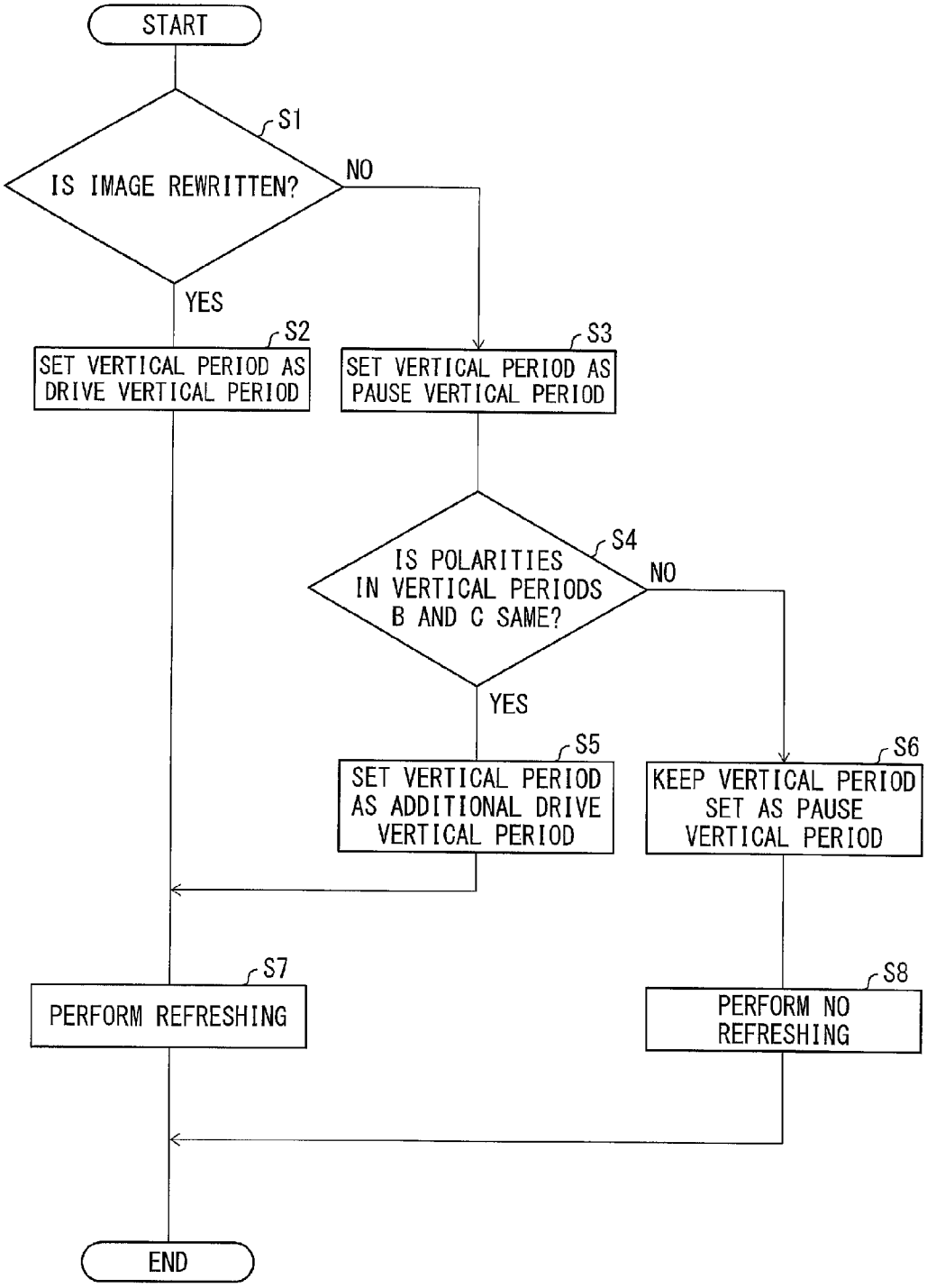
FIG. 5 is a flowchart showing a flow of display control carried out by a display control section of the display device.

FIG. 5 is a flowchart showing a flow of display control carried out by the display control section 30. The following describes a specific flow of display control carried out by each block of the display control section 30, with reference to Example Operation 1.

In a case where a vertical period of interest (current vertical period) is included in a term in which an image is to be rewritten (Yes in S1), the rewriting determining section 36 of the refresh control section 34 sets the vertical period of interest as a drive vertical period (S2).

On the other hand, in a case where the vertical period of interest (e.g., the $5^{th}$ vertical period) is included in a term A (first term) in which an image is not rewritten (No in S1), the rewriting determining section 36 tentatively sets the vertical period of interest as a pause vertical period (S3).

Subsequent to S3, the polarity determining section 35 determines whether or not a polarity (first polarity) of a drive vertical period B (second vertical period) immediately preceding the term A in which an image is not rewritten is the same as a polarity (second polarity) of a last pause vertical period C (third vertical period) preceding the drive vertical period B (S4). The drive vertical period B here is a drive vertical period (including an additional drive vertical period) immediately preceding the vertical period of interest (pause vertical period). In a case where other drive vertical period successively occurs before the drive vertical period B, the pause vertical period C is a last pause vertical period preceding a plurality of successive drive vertical periods (including the drive vertical period B). In a case where a vertical period immediately preceding the drive vertical period B is a pause vertical period, this pause vertical period is the pause vertical period C. The polarity stays the same from the pause vertical period C at least to a last drive vertical period preceding the pause vertical period C. Then, in a case where the second polarity of the pause vertical period C is the same as the first polarity of the drive vertical period B, positive-polarity vertical periods and negative-polarity vertical periods may be unbalanced in terms of length over a long period of time unless the polarity is reversed in the term A in which an image is not rewritten after the drive vertical period B.

In a case where the polarity is reversed every time refreshing is performed, the polarity determining section 35 can determine that the first polarity and the second polarity are the same if the number of successive drive vertical periods is an even number. Meanwhile, the polarity determining section 35 can determine that the first polarity and the second polarity are different from each other if the number of successive drive vertical periods is an odd number. In order to carry out the above determination, the polarity determining section 35 can store information as to whether a predetermined number of past vertical periods each were a drive vertical period (including an additional drive vertical period) or a pause vertical period. Alternatively, in order to carry out the above determination, the polarity determining section 35 can store the number of successive drive vertical periods. As a further alternative, in order to more simply carry out the above determination, the polarity determining section 35 can store information as to whether the number of successive drive vertical periods is an odd number or an even number.

In a case where the first polarity of the drive vertical period B is the same as the second polarity of the pause vertical period C (Yes in S4), the addition determining section 37 of the refresh control section 34 sets the vertical period of interest ($5^{th}$ vertical period) in which an image is not rewritten, as an additional drive vertical period (S5).

After S2 or S5, the vertical period of interest is set as a drive vertical period (including an additional drive vertical period). Accordingly, the TG 33 reads out image data from the memory 32, and outputs the image data to the source driver 21 for refreshing. The source driver 21 reverses a polarity of an immediately preceding drive vertical period to the other polarity, and supplies a data signal to each pixel of the display section 10. In other words, the display driving section 20 carries out refreshing of the display section 10 (S7).

On the other hand, in a case where the first polarity of the drive vertical period B is different from the second polarity of the pause vertical period C (No in S4), the addition determining section 37 of the refresh control section 34 keeps the vertical period of interest in which an image is not rewritten set as a pause vertical period (S6). In a case where a pause vertical period is to be set in S6, the processing in S3 for a tentative setting can be omitted.

After S6, the vertical period of interest is set as a pause vertical period. Accordingly, the TG 33 does not supply image data to the source driver 21. Further, the display driving section 20 does not refresh the display section 10 (S8).

In the additional drive vertical period, the source driver 21 performs refreshing (writing of a data signal in the pixel) by using a polarity (−) that is different from the first and second polarities (+). This can make a polarity used in periods in and before the pause vertical period C different from a polarity used in periods in and subsequent to the vertical period of interest ($5^{th}$ vertical period). This makes it possible to shorten the length of an unbalanced-polarity term, which loses a balance in length between positive-polarity vertical periods and negative-polarity vertical periods, in a long period of time.

(Modification)

In Example Operation 1 of Embodiment 1, the initial (first) vertical period ($5^{th}$ vertical period) of a term A, in which an image is not rewritten, immediately following an even number of successive drive vertical period is set as an additional drive vertical period. However, the present invention is not limited to this configuration. For example, it is possible to set, as an additional drive period, a vertical period subsequent to a predetermined number of pause vertical periods which follows an even number of successive drive vertical periods. In a case where a term in which an image is not rewritten is long, the length of an unbalanced-polarity term, which loses a balance in length between positive-polarity vertical periods and negative-polarity vertical periods, can be shortened in a long period of time even if some pause vertical periods intervene between (i) an even number of successive drive vertical periods and (ii) an additional drive vertical period subsequent to the even number of successive drive vertical periods. The number of pause vertical periods provided between (i) such an even number of successive drive vertical periods and (ii) such an additional drive vertical period following the even number of successive drive vertical periods is preferably not less than 0 and not more than 4.

Further, in one term A in which an image is not rewritten, more than one additional drive vertical period can be provided. In this case, an odd number of additional drive vertical periods should be provided in the term A in which an image is not rewritten. Note that the number of additional drive vertical periods is preferably 1 or 3. This is because, as the number of additional drive vertical periods increases, an energy saving effect reduces. It does not matter whether a pause vertical period is provided between an odd number (more than 1) of additional drive vertical periods.

In a case where a vertical period subsequent to several vertical periods following drive vertical period B has been set as an additional drive vertical period and thereafter this additional drive vertical period is set as a vertical period in which an image is rewritten, regular refreshing accompanied by image rewriting should be performed in the vertical period. In other words, the setting of the vertical period as an additional drive vertical period should be cancelled.

Note that the above modification can be applied also to the other embodiments discussed below.

[Embodiment 2]

Embodiment 2 is different from Embodiment 1 in that Embodiment 2 determines whether or not to add an additional vertical period in accordance with a refresh rate, in addition to determination of a polarity.

Figure 6:
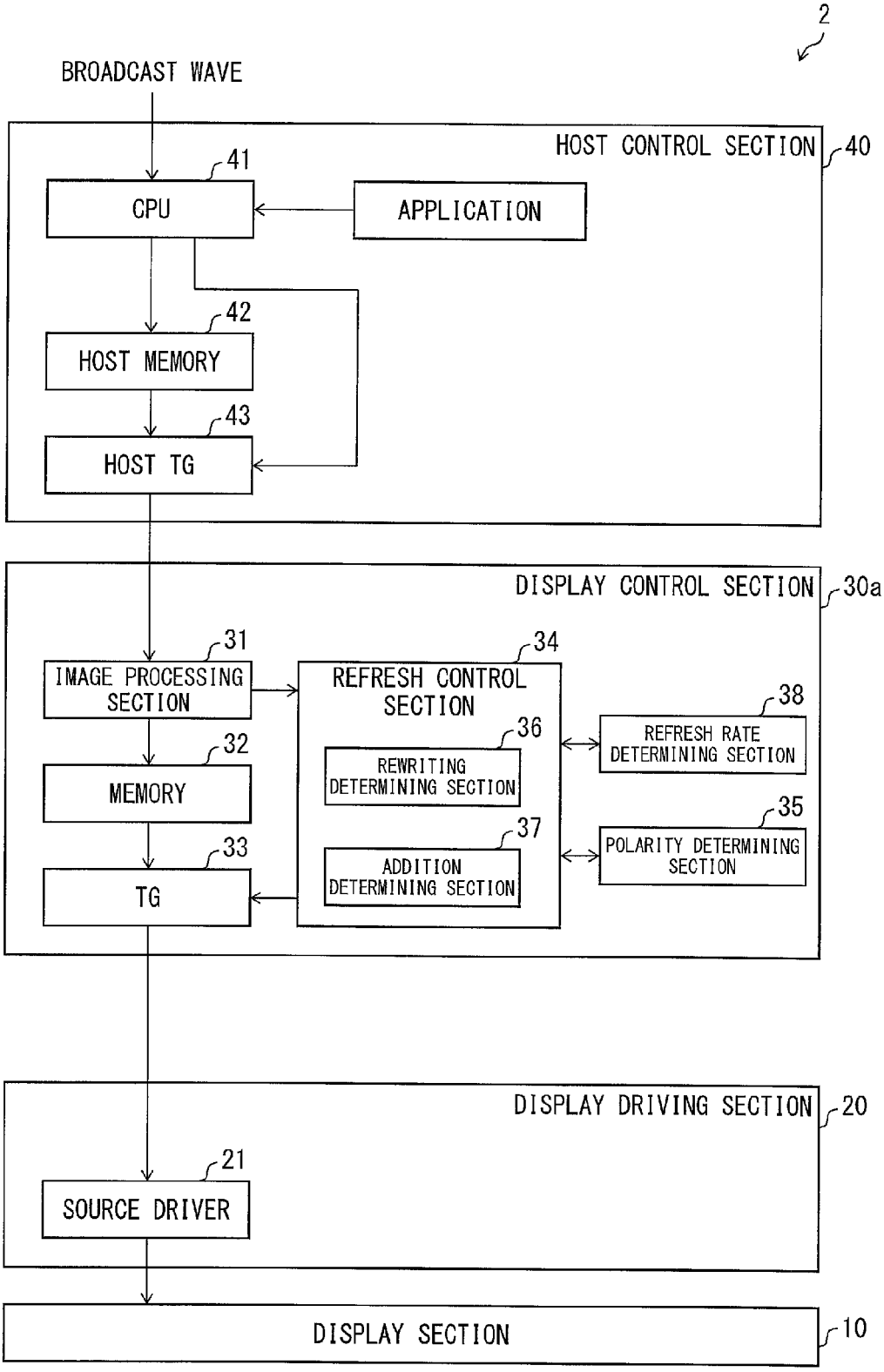
FIG. 6 is a block diagram illustrating a configuration of a display device in accordance with another embodiment of the present invention.

FIG. 6 is a block diagram illustrating a configuration of a display device 2 of Embodiment 2. The display device 2 includes a display section 10, a display driving section 20, a display control section 30*a*, and a host control section 40. The configurations of the display driving section 20 and the host control section 40 are the same as those in Embodiment 1.

(Configuration of Display Control Section 30*a*)

The display control section 30*a* includes an image processing section 31, a memory 32, a TG 33, a refresh control section 34, a polarity determining section 35, and a refresh rate determining section 38. The image processing section 31, the memory 32, the TG 33, and the polarity determining section 35 are configured as in Embodiment 1.

The refresh rate determining section 38 finds out a refresh rate, on the basis of whether each of past vertical periods is a drive vertical period (including an additional drive vertical period) or a pause vertical period. The refresh rate determining section 38 determines whether or not thus found refresh rate is less than a predetermined value. Then, the refresh rate determining section 38 notifies a determination result to the refresh control section 34.

In a case where the refresh rate is not less than the predetermined value, the addition determining section 37 of the refresh control section 34 provides no additional drive vertical period regardless of the determination result from the polarity determining section 35. On the other hand, in a case where (i) the refresh rate is less than the predetermined value and (ii) the first polarity is the same as the second polarity, the addition determining section 37 provides an additional drive vertical period in which refreshing is performed by using a polarity opposite to the first polarity, in a term in which an image is not rewritten.

(Example Operation 2)

Figure 7:
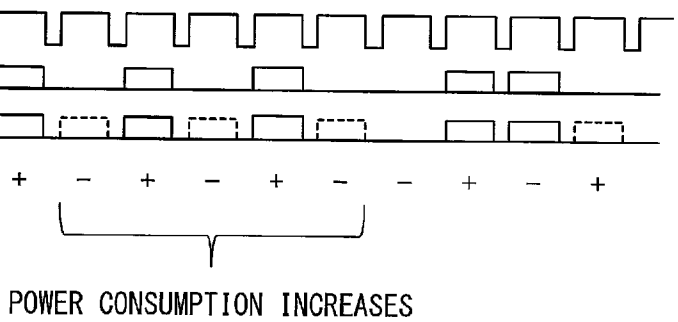
FIG. 7 is a timing chart for image rewriting and refreshing in an example operation in accordance with the one embodiment of the present invention.

FIG. 7 is a timing chart for image rewriting and refreshing in Example Operation 2. Respective elements in FIG. 7 indicate the same as those in FIG. 2. Example Operation 2 is not an operation of Embodiment 2 but the same as an operation of Embodiment 1. In other words, in Example Operation 2, a vertical period immediately following an even number of successive drive vertical periods is set as an additional drive vertical period, regardless of a refresh rate. Timing for image rewriting in FIG. 7 is different from that shown in FIG. 4.

For example, in a case where a $13^{th}$ vertical period is taken as a vertical period of interest, the $13^{th}$ vertical period is set as an additional drive vertical period. This is because immediately before the $13^{th}$ vertical period, an even number of successive drive vertical periods ($11^{th}$ and $12^{th}$ vertical periods) occur.

Then, in a case where a $15^{th}$ vertical period is taken as a vertical period of interest, the $15^{th}$ vertical period is also set as an additional drive vertical period. This is because the $13^{th}$ vertical period has been set as an additional drive vertical period, and as a result, an even number of successive drive vertical periods ($11^{th}$ to $14^{th}$ vertical periods) occur immediately before the $15^{th}$ vertical period.

Similarly, an even number of successive drive vertical periods ($11^{th}$ to $16^{th}$ vertical periods) occur immediately before a $17^{th}$ vertical period. Accordingly, the $17^{th}$ vertical period is also set as an additional drive vertical period.

As described above, when additional drive vertical periods are provided in a case where an image is rewritten in substantially half of all vertical periods, additional drive vertical periods may be provided one after another in chains in a subsequent term. For example, in light of the length of an unbalanced-polarity term which loses a balance in length between positive-polarity vertical periods and negative-polarity vertical periods, it is not necessary to set the $13^{th}$, $15^{th}$, and $17^{th}$ vertical periods as additional drive vertical periods. In a term in which an image is frequently rewritten (refreshing accompanied by image rewriting is frequently performed), the length of an unbalanced-polarity term which loses a balance in length between positive-polarity vertical periods and negative-polarity vertical periods is not long and therefore it is not necessary to provide an additional drive vertical period. Provision of an additional vertical period in such vertical periods causes a problem that power consumption unnecessarily increases.

(Example Operation 3)

In Embodiment 2, in order to solve the problem that power consumption unnecessarily increases depending on timing of image rewriting, whether to add an additional vertical period is determined in accordance with a refresh rate. The following describes an operation (Example Operation 3) of the display device 2 of Embodiment 2.

Figure 8:
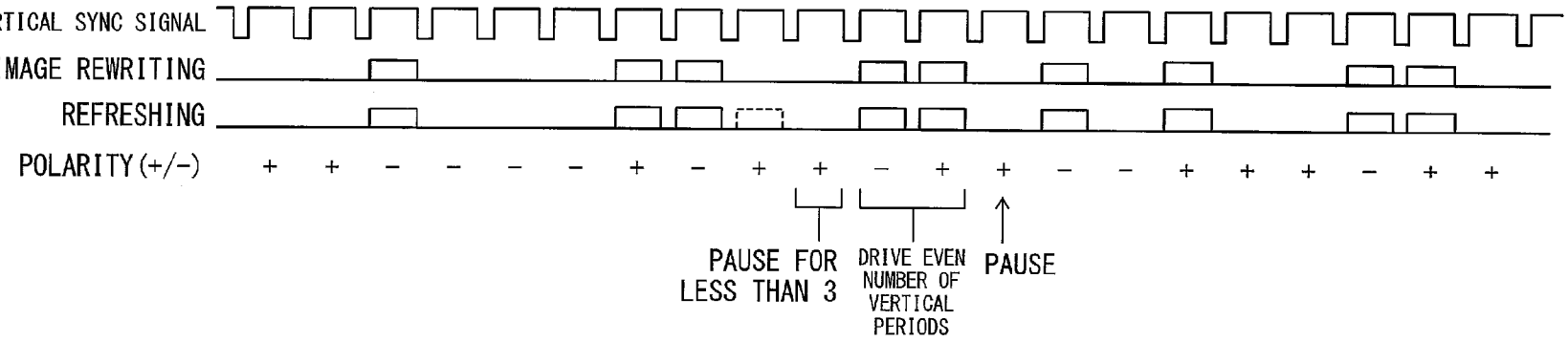
FIG. 8 is a timing chart for image rewriting and refreshing in the display device in accordance with the another embodiment of the present invention.

FIG. 8 is a timing chart for image rewriting and refreshing in the display device 2 in accordance with Embodiment 2. Respective elements in FIG. 8 indicate the same as those in FIG. 2. Timing for image rewriting in FIG. 8 is the same as that in Example Operation 2 shown in FIG. 7.

The display device 2 performs refreshing in each vertical period in a term in which an image is rewritten. In a case where the refresh rate is lower than a predetermined value, the display device 2 performs additional refreshing in a vertical period in which an image is not rewritten immediately following an even number of successive drive vertical periods. Note however that the display device 2 does not perform additional refreshing in a case where the refresh rate is not less than the predetermined value.

More specifically, $7^{th}$ and $8^{th}$ vertical periods are periods in each of which an image is rewritten, and therefore are an even number of successive drive vertical periods. Since a refresh rate in a predetermined term preceding the $7^{th}$ vertical period is lower than the predetermined value, the display device 2 performs additional refreshing in a $9^{th}$ vertical period. The $9^{th}$ vertical period is set as an additional drive vertical period. Here, in a case where not less than three successive pause vertical periods occur immediately before an even number of successive drive vertical periods, the display device 2 determines that the refresh rate is less than the predetermined value. On the other hand, in a case where there are less than three successive pause vertical periods immediately preceding an even number of successive drive vertical periods, the display device 2 determines that the refresh rate is not less than the predetermined value. This makes it possible to easily determine whether the refresh rate is high or low.

Meanwhile, there is only one pause vertical period (only a $10^{th}$ vertical period) immediately preceding an even number of successive drive vertical periods ($11^{th}$ and $12^{th}$ vertical periods) subsequent to the $9^{th}$ vertical period. Accordingly, the display device 2 determines that the refresh rate is not less than the predetermined value at a $13^{th}$ vertical period. Therefore, the display device 2 sets the $13^{th}$ vertical period not as an additional drive vertical period but as a pause vertical period.

Unlike Example Operation 2, the $13^{th}$ vertical period is set as a pause vertical period in Example Operation 3. As a result, $14^{th}$ and $16^{th}$ vertical periods each correspond to an odd number of successive drive vertical periods. Therefore, a $15^{th}$ vertical period immediately following the $14^{th}$ vertical period and a $17^{th}$ vertical period immediately following the $16^{th}$ vertical period each are set as a pause vertical period. Moreover, a refresh rate at a $21^{st}$ vertical period is also determined to be not less than the predetermined value, and therefore, the $21^{st}$ vertical period is set as a pause vertical period.

In a term in which refreshing accompanied by image rewriting is frequently performed, the polarity is reversed every time the refreshing is performed and therefore, the polarity is less unbalanced. The display device 2 of Embodiment 2 provides no additional drive vertical period in such a term in which the refresh rate is high. This makes it possible to prevent an increase in power consumption. On the other hand, the display device 2 of Embodiment 2 provides an additional drive vertical period in a term in which the refresh rate is low. This makes it possible to prevent loss of a balance in length between positive-pixel-polarity vertical periods and negative-polarity vertical periods over a long period of time. Consequently, the display device 2 is capable of preventing a flicker from being viewed by a user as well as reducing power consumption by appropriately providing a pause vertical period.

(Flow of Display Control)

Figure 9:
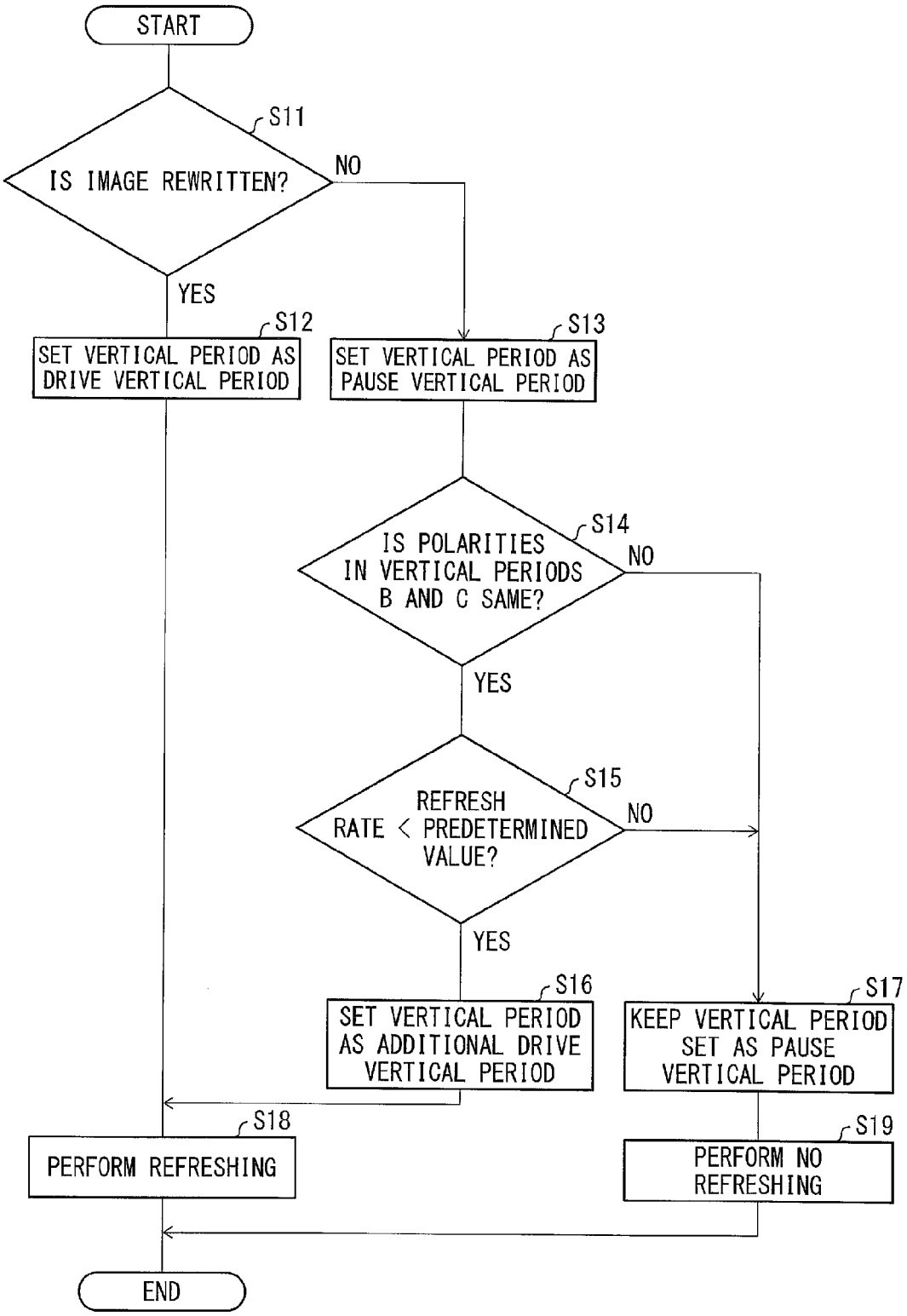
FIG. 9 is a flowchart showing a flow of display control carried out by a display control section of the display device.

FIG. 9 is a flowchart showing a flow of display control carried out by the display control section 30*a*. The following describes a specific flow of display control carried out by each block of the display control section 30*a*, with reference to Example Operation 3. Note that the steps S11 through S14 and S16 through S19 shown in FIG. 9 are the same as the steps S1 through S8 shown in FIG. 5, respectively and descriptions of the steps are omitted here.

In a case where a first polarity of a drive vertical period B ($8^{th}$ and $12^{th}$ vertical periods) are the same as a second polarity of a last pause vertical period C ($6^{th}$ and $10^{th}$ vertical periods) preceding the drive vertical period B (Yes in S14), the refresh rate determining section 38 determines whether or not a refresh rate is less than the predetermined value (S15).

In a case where the refresh rate is less than the predetermined value (Yes in S15), the addition determining section 37 of the refresh control section 34 sets, as an additional drive vertical period, a vertical period of interest ($9^{th}$ vertical period) in which an image is not rewritten (S16).

On the other hand, in a case where the refresh rate is not less than the predetermined value (No in S15), the addition determining section 37 of the refresh control section 34 keeps setting, as a pause vertical period, the vertical period of interest ($13^{th}$ vertical period) in which an image is not rewritten (S17).

Note that in S15, in a case where the number of successive pause vertical periods including the pause vertical period C is not less than 3, the refresh rate determining section 38 determines that the refresh rate is less than the predetermined value. In other words, in a case where two (predetermined number) vertical periods immediately preceding the pause vertical period C are pause vertical periods, the refresh rate determining section 38 determines that the refresh rate is less than the predetermined value. In order to carry out the above determination, the refresh rate determining section 38 can store the number of successive pause vertical periods preceding a drive vertical period. Alternatively, the refresh rate determining section 38 can store information as to whether more than one past vertical period is a drive vertical period (including an additional drive vertical period) or a pause vertical period. This allows the refresh rate determining section 38 to determine the refresh rate by a simple configuration and simple processing.

Further, the refresh rate determining section 38 can obtain a refresh rate in an immediately preceding term, on the basis of whether or not refreshing is performed in each of a predetermined number (e.g., approximately 30) of vertical periods immediately preceding a term A in which an image is not rewritten. The refresh rate determining section 38 can store information as to whether each vertical period in a past predetermined term (a predetermined number of past vertical periods) is a drive vertical period (including an additional drive vertical period) or a pause vertical period, and thereby can obtain, on the basis of the above information, the refresh rate (=the number of drive vertical periods/the total number of vertical periods) in the past predetermined term. The refresh rate determining section 38 determines whether or not thus obtained refresh rate is less than the predetermined value. This predetermined value can be set to, for example, a value (e.g., not more than 30 Hz) that is not more than half of a vertical period rate (e.g., 60 Hz), but is not limited thereto. In the above case, the refresh rate determining section 38 can more precisely determine the refresh rate.

Note that the order of the steps of determining the refresh rate (S15) and determining the polarity (S14) can be reversed.

[Embodiment 3]

Embodiment 3 discusses a case where refreshing that is not accompanied by polarity reversal is performed, that is, a case where polarity reversal is not carried out every time refreshing is performed. A display device of Embodiment 3 is configured in the same manner as that in the block diagram illustrated in FIG. 1. However, the display device of Embodiment 3 is different from Embodiment 1, in processing performed by a display control section 30 and a display driving section 20.

In Embodiment 3, the display control section 30 generates an interpolation frame (intermediate frame) for a moving image which the display control section 30 receives from a host control section 40, and causes the moving image by double speed drive. In a case where the maximum frame rate of a moving image is 60 Hz, the maximum refresh rate of a display section 10 is 120 Hz. The host control section 40 supplies, at a rate up to 60 Hz at the maximum, image data to the display control section 30 only in a case where an image of original image data is to be rewritten.

In a case where two successive frames in each of which an image is rewritten occur at 60 Hz, an image processing section 31 generates an interpolation frame indicative of an intermediate image between the two successive frames one of which precedes the interpolation frame and the other one of which follows the interpolation frame. The image processing section 31 generates no interpolation frame in a case where an interval between the two successive frames is long.

A TG 33 supplies, at a rate up to 120 Hz at the maximum, image data of an original frame or image data of an interpolation frame to the display driving section 20. The TG 33 also instructs the display driving section 20 to reverse a polarity of a data signal in writing an original frame in each pixel, whereas instructing the display driving section 20 not to reverse a polarity of a data signal in writing an interpolation frame in each pixel. This is because polarity reversal in an interpolation frame increases the number of times of polarity reversal, and consequently causes an increase in power consumption.

In a case where a vertical period of interest (current vertical period) is in a term in which an image is not rewritten, a polarity determining section 35 determines whether or not a first polarity is the same as a second polarity. The first polarity here is a polarity of a drive vertical period immediately preceding the term in which an image is not rewritten. The second polarity is a polarity of a last pause vertical period preceding the drive vertical period. In order to carry out the above determination, the polarity determining section 35 can store information as to whether each of a predetermined number of vertical periods is a drive vertical period (including additional drive vertical period) or a pause vertical period, and a pixel polarity in each vertical period.

In a case where the first polarity is the same as the second polarity, an addition determining section 37 of a refresh control section 34 provides an additional drive vertical period in which refreshing is performed by using a polarity opposite to the first polarity, in the term in which an image is not rewritten. On the other hand, in a case where the first polarity is different from the second polarity, the refresh control section 34 provides no additional drive vertical period in the term in which an image is not rewritten.

The refresh control section 34 also instructs the TG 33 as to whether or not to reverse a polarity in each drive vertical period. The refresh control section 34 instructs to reverse a polarity in (i) a drive vertical period in which an original frame (original image data) is to be written and (ii) an additional drive vertical period, whereas the refresh control section 34 instructs not to reverse a polarity in a drive vertical period in which an interpolation frame is to be written. In a pause period, no refreshing is performed and accordingly a polarity is reversed.

(Example Operation 4)

The following describes an operation (Example Operation 4) of a display device 1 in Embodiment 3.

Figure 10:
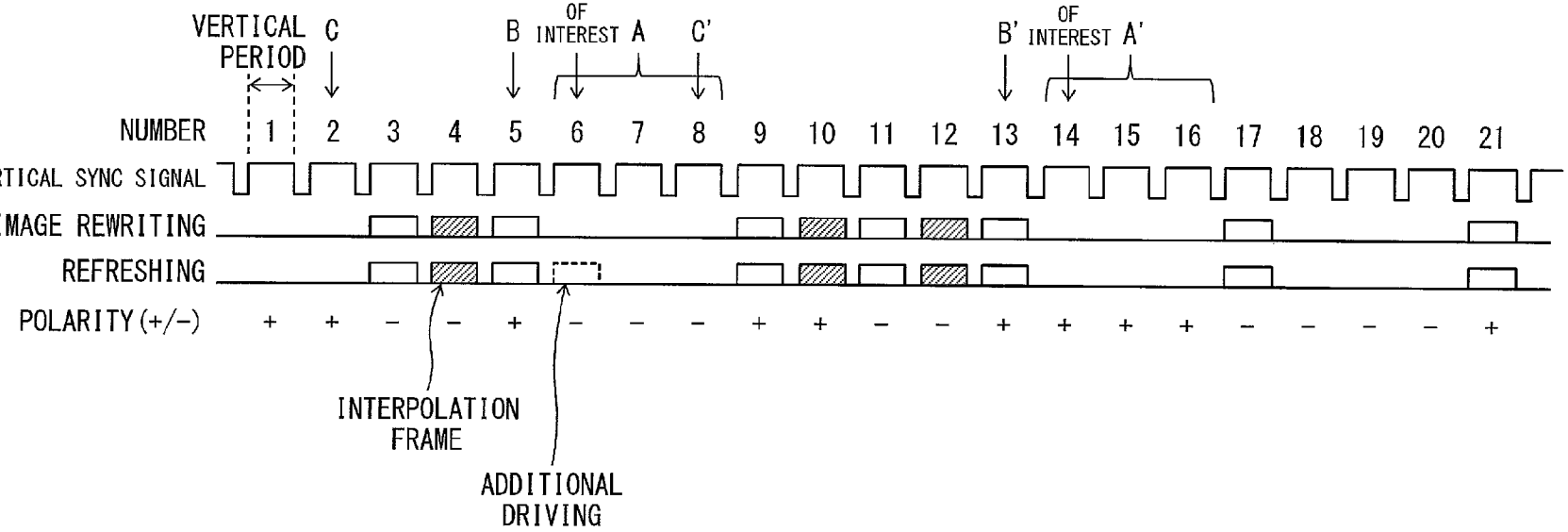
FIG. 10 is a timing chart for image rewriting and refreshing in a display device in accordance with still another embodiment of the present invention.

FIG. 10 is a timing chart for image rewriting and refreshing in the display device 1 in accordance with Embodiment 3. Respective elements in FIG. 10 indicate the same as those in FIG. 2. In FIG. 10, diagonally hatched rectangles on a line of "image rewriting" each indicate that an image is rewritten so that an image of an interpolation frame will be written, while diagonally hatched rectangles on a line of "refreshing" each indicate that an interpolation frame is written. Meanwhile, rectangles having no diagonal lines indicate that original image data (frame) is written. A dotted-line rectangle on the line of "refreshing" indicates refreshing in an additional drive vertical period. In the additional drive vertical period, a data signal written in a pixel corresponds to image data which is the same, except for polarity, as image data in an immediately preceding drive vertical period. Note that in FIG. 10, there are 120 vertical periods per second (i.e., driving is carried out at 120 Hz).

In each of $3^{rd}$ and $5^{th}$ vertical periods in which original image data is written, a polarity of an immediately preceding vertical period is reversed. In contrast, in a $4^{th}$ vertical period in which an interpolation frame is written, a polarity of an immediately preceding vertical period is not reversed. When original image data is written in series at 60 Hz as in a term between the $3^{rd}$ vertical period and the $5^{th}$ vertical period, an interpolation frame is displayed in the $4^{th}$ vertical period between the $\mathbf{3}^{rd}$ and $\mathbf{5}^{th}$ vertical periods. On the other hand, in a term ($6^{th}$ to $8^{th}$ vertical periods) where a frame rate of the original image data is less than 60 Hz as in a term between the $5^{th}$ vertical period and a $9^{th}$ vertical period, no interpolation frame is displayed.

Next, a $6^{th}$ vertical period is taken as a vertical period of interest. The $6^{th}$ vertical period is an initial vertical period in a term A in which an image is not rewritten. Though the $3^{rd}$ to $5^{th}$ vertical periods are an odd number of successive drive vertical periods, a polarity (first polarity) in a drive vertical period B ($5^{th}$ vertical period) immediately preceding the $6^{th}$ vertical period is the same as a polarity (second polarity) in a last pause vertical period C ($2^{nd}$ vertical period) preceding the drive vertical period B. In a case where the first polarity of the drive vertical period B is the same as the second polarity of the pause vertical period C, the addition determining section 37 of the refresh control section 34 sets the vertical period of interest ($6^{th}$ vertical period) in which an image is not rewritten, as an additional drive vertical period in which a polarity is reversed. Such provision of the additional drive vertical period leads to reversal of a pixel polarity before and after successive drive vertical periods.

Next, a $14^{th}$ vertical period is taken as a vertical period of interest. The $14^{th}$ vertical period is an initial vertical period in a term A' in which an image is not rewritten. The $9^{th}$ to $13^{th}$ vertical periods are an odd number of successive drive vertical periods. A polarity (first polarity) in a drive vertical period B' ($13^{th}$ vertical period) immediately preceding the $14^{th}$ vertical period is different from a polarity (second polarity) in a last pause vertical period C' ($8^{th}$ vertical period) preceding the drive vertical period B'. In a case where the first polarity of the drive vertical period B' is different from the second polarity of the pause vertical period C', the addition determining section 37 of the refresh control section 34 sets, as a pause vertical period, the vertical period of interest ($14^{th}$ vertical period) in which an image is not rewritten.

As described above, in Embodiment 3, an additional drive vertical period in which a polarity is reversed is provided in a term A in which an image is not rewritten, depending on a second polarity of a pause vertical period C immediately preceding successive drive vertical periods and a first polarity of a last drive vertical period B in the successive drive vertical periods. This makes it possible to appropriately reverse the polarity before and after the successive drive vertical periods, even in a case where there is a drive vertical period (e.g., $4^{th}$ vertical period) in which a polarity is not reversed. Therefore, the display device 1 of Embodiment 3 can prevent loss of a balance in length between positive-pixel-polarity vertical periods and negative-pixel-polarity vertical periods over a long period of time. This consequently makes it possible not only to prevent a flicker from being viewed by a user but also to reduce power consumption by providing a pause vertical period.

Note that though the number of interpolation frames between two original frames is 1 in the above, a plurality of interpolation frames can be generated between two original frames.

Further, though the vertical period corresponding to the interpolation frame is assumed in the above to be a drive vertical period in which a polarity is not reversed, the present invention is not limited to this configuration. One aspect of the present invention is applicable to an instance in which a polarity is not reversed in a case where part of original image data is rewritten.

[Embodiment 4]

Embodiment 4 is different from Embodiment 2 in that a display device of Embodiment 4 does not include a substrate of a display control section and that a refresh control section, for example, is formed on a substrate of a host control section.

Figure 11:
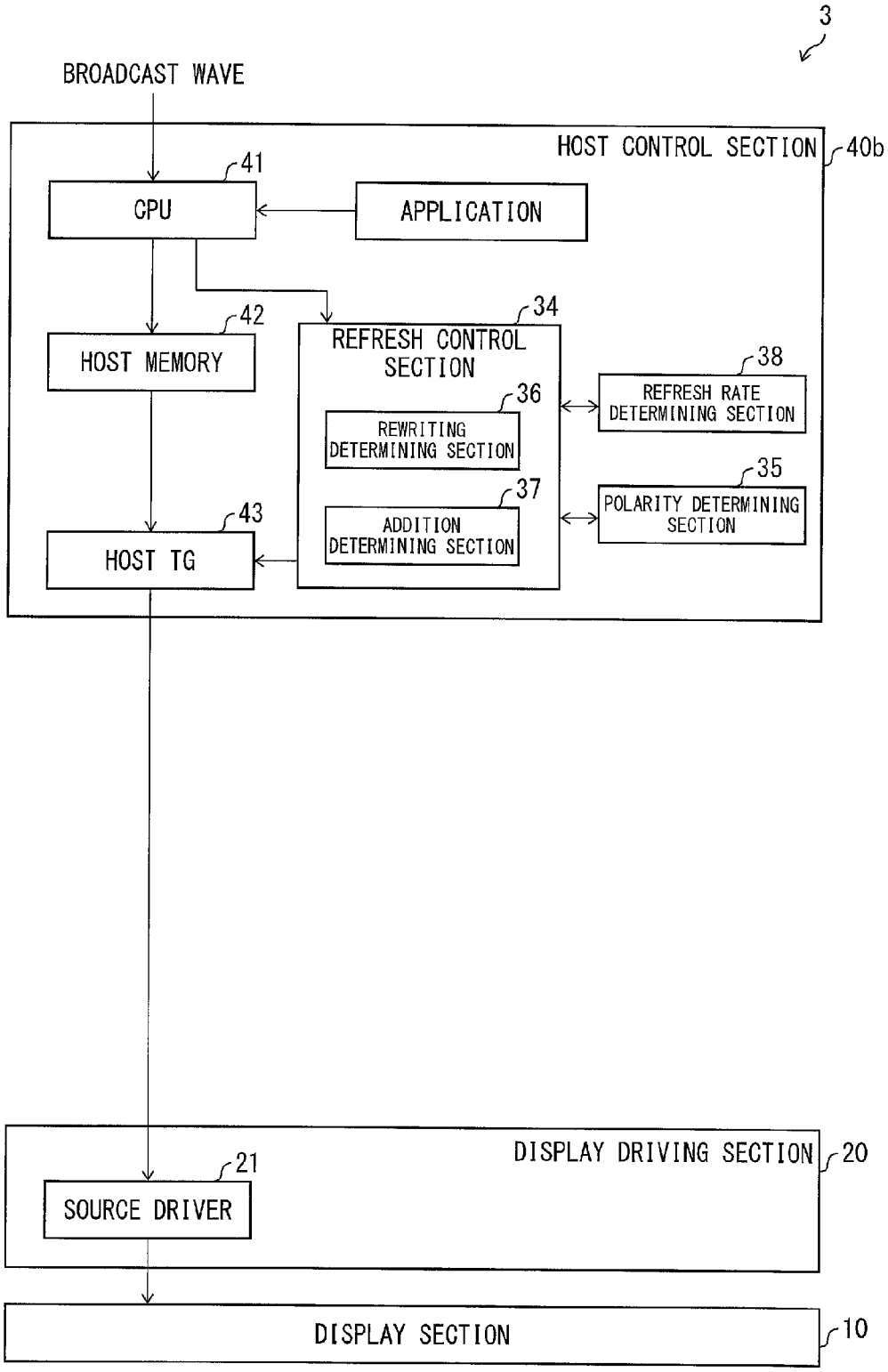
FIG. 11 is a block diagram illustrating a configuration of the display device in accordance with still another embodiment of the present invention.

FIG. 11 is a block diagram illustrating a configuration of a display device 3 in accordance with Embodiment 4. The display device 3 includes a display section 10, a display driving section 20, and a host control section 40*b*. The display section 10 and the display driving section 20 are configured as in Embodiments 1 and 2.

(Configuration of Host Control Section 40*b*)

The host control section 40*b* includes a CPU 41, a host memory 42, a host TG 43, a refresh control section 34, a refresh rate determining section 38, and a polarity determining section 35. The refresh control section 34, the refresh rate determining section 38, and the polarity determining section 35 each operate as in Embodiment 2.

The host TG 43 transfers image data to the display driving section 20 only in a drive vertical period (including an additional drive vertical period) in which refreshing is performed. The host TG 33 also generates a timing signal for driving the display section 10, and supplies this timing signal to the source driver 21.

In a case where as in the above-described configuration, the substrate of the display control section is omitted and the host control section 40*b* is caused to determine whether or not to provide an additional drive vertical period, a whole display device can be configured in a simpler manner.

[Embodiment 5]

Embodiment 5 is different from Embodiment 2 in that a display device of Embodiment 5 does not include a substrate of a display control section and that a refresh control section, for example, is formed in a display driving section which is a COG driver.

Figure 12:
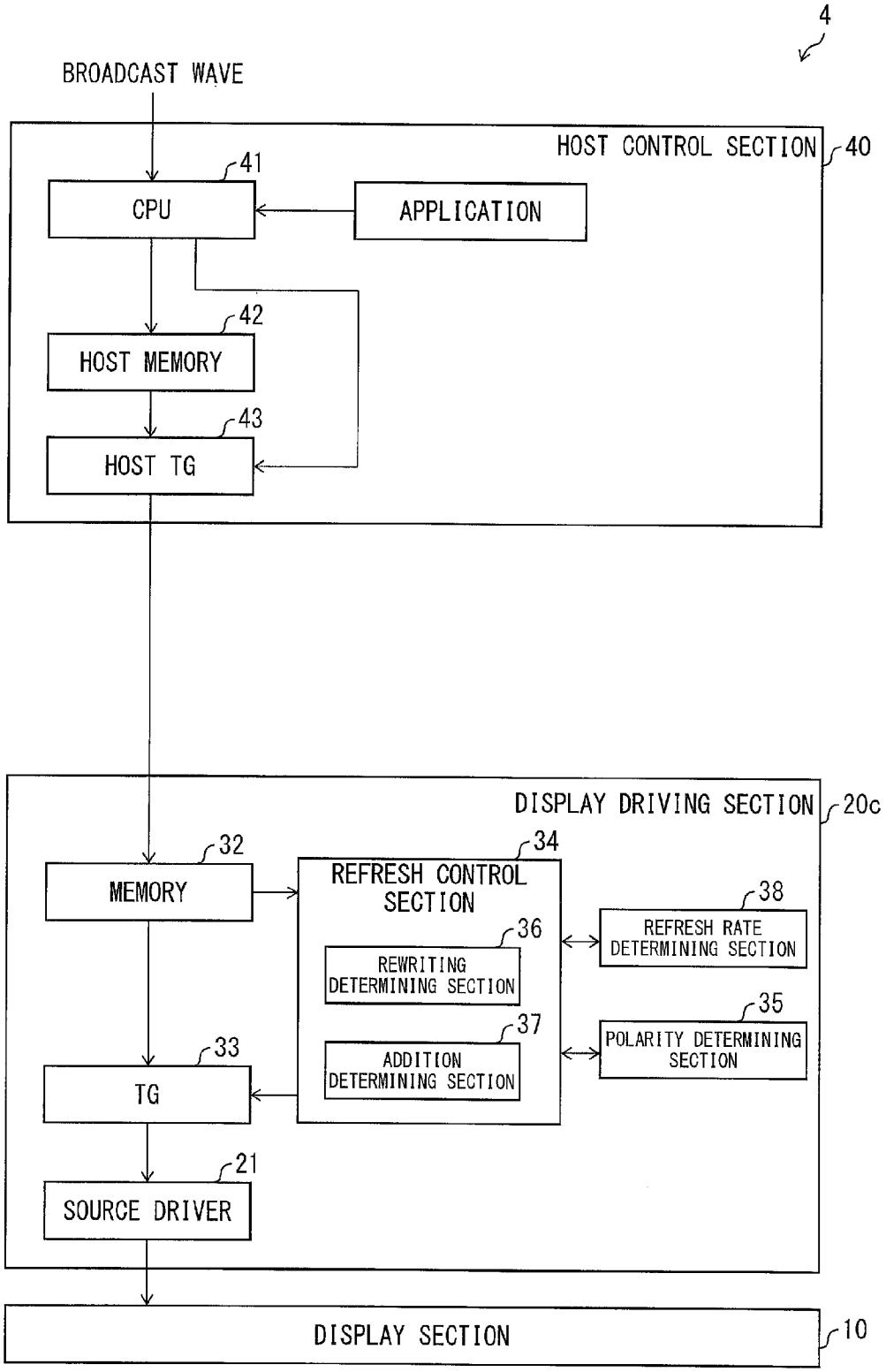
FIG. 12 is a block diagram illustrating a configuration of a display device in accordance with still another embodiment of the present invention.

FIG. 12 is a block diagram illustrating a configuration of a display device 4 in accordance with Embodiment 5. The display device 4 includes a display section 10, a display driving section 20*c*, and a host control section 40.

The host control section 40 is configured as in Embodiment 2, except that a host TG 43 transfers image data to the display driving section 20*c* only in a case where an image is rewritten.

The display driving section 20*c* includes a memory 32, a TG 33, a refresh control section 34, a refresh rate determining section 38, a polarity determining section 35, and a source driver 21. Each section of the display driving section 20*c* operates in the same manner as that in Embodiment 2.

In Embodiment 5, the COG driver (display driving section 20*c*) determines whether to drive the display section 10 or cause the display section 10 to pause. This makes it possible to reduce load on the host control section 40 in a configuration in which an additional substrate is not provided separately from the host control section 40. The COG driver formed on an active matrix substrate is limited in mounting area. Accordingly, Embodiment 5 is suitable in a case where a polarity determining section 35 and a refresh rate determining section 38 carry out only simple determination processing.

[Software Implementation Example]

Control blocks of the display devices 1 to 4 (particularly, the refresh control section 34, the polarity determining section 35, and the refresh rate determining section 38) can be realized by a logic circuit (hardware) provided in an integrated circuit (IC chip) or the like or can be alternatively realized by software as executed by a CPU (Central Processing Unit).

In the latter case, the display devices 1 to 4 each include a CPU that executes instructions of a program that is software realizing the foregoing functions; ROM (Read Only Memory) or a storage device (each referred to as "storage medium") in which the program and various kinds of data are stored so as to be readable by a computer (or a CPU); and RAM (Random Access Memory) in which the program is loaded. An object of the present invention can be achieved by a computer (or a CPU) reading and executing the program stored in the storage medium. Examples of the storage medium encompass "a non-transitory tangible medium" such as a tape, a disk, a card, a semiconductor memory, and a programmable logic circuit. The program can be supplied to the computer via any transmission medium (such as a communication network or a broadcast wave) which allows the program to be transmitted. Note that the present invention can also be achieved in the form of a computer data signal in which the program is embodied via electronic transmission and which is embedded in a carrier wave.

[Overview]

A display device in accordance with Aspect 1 of the present invention is a display device in which a polarity of a data signal written in each pixel is reversed depending on whether or not refreshing of a display screen is performed, the display device including: a refresh control section (34) for setting vertical periods in each of which an image is rewritten, as vertical periods in each of which the refreshing is performed, and providing, in a term in which an image is not rewritten, a vertical period in which the refreshing is caused to pause; and a polarity determining section (35) for determining whether or not a first polarity in a second vertical period (vertical period B) in which the refreshing is performed is the same as a second polarity in a third vertical period (vertical period C) in which the refreshing is caused to pause, the second vertical period immediately preceding a first term (term A) in which an image is not rewritten, the third vertical period being a last period in which the refreshing is caused to pause before the second vertical period, in a case where the first polarity is the same as the second polarity, the refresh control section providing, in the first term, an additional vertical period (additional drive vertical period) in which the refreshing is performed by using a polarity opposite to the first polarity.

In the above configuration, the polarity can be reversed in each or some of cases where refreshing is performed. In a case where there is a plurality of successive drive vertical periods in each of which refreshing is performed, the third vertical period is a pause vertical period immediately preceding the plurality of successive drive vertical periods including the second vertical period. Further, the second vertical period is a last drive vertical period of the plurality of successive drive vertical periods.

The above configuration allows for efficient polarity reversal of each pixel, and thereby makes it possible to prevent loss of a balance in length between positive-pixel-polarity vertical periods and negative-pixel-polarity vertical periods in each pixel over a long period of time. This consequently makes it possible not only to prevent a flicker from being viewed by a user but also to reduce power consumption by providing a vertical period in which refreshing is caused to pause.

A display device in accordance with Aspect 2 of the present invention can be configured such that in Aspect 1, the polarity of the data signal written in the each pixel is reversed every time the refreshing is performed.

In the above configuration, in a case where there occur an even number of vertical periods in each of which refreshing is performed, the first polarity becomes the same as the second polarity. The polarity determining section can determine whether or not the first polarity is the same as the second polarity on the basis of whether or not the number of successive vertical periods in each of which refreshing is performed is an even number or an odd number. Therefore, the polarity determining section can carry out determination processing by a simple configuration.

A display device in accordance with Aspect 3 of the present invention can be configured to further include, in Aspect 2, a refresh rate determining section (38) for determining whether or not a refresh rate is less than a predetermined value, in a case where the refresh rate is less than the predetermined value and the first polarity is the same as the second polarity, the refresh control section providing the additional vertical period in the first term, and in a case where the refresh rate is not less than the predetermined value, the refresh control section providing no additional vertical period in the first term.

The above configuration makes it possible to perform additional refreshing in such a manner that an unnecessary increase in number of times of polarity reversal is prevented at a high refresh rate and a polarity is effectively reversed at a low refresh rate. This makes it possible not only to suppress power consumption but also maintain display quality.

A display device in accordance with Aspect 4 of the present invention can be configured such that in any one of the above Aspects 1 to 3, the refresh control section provides an odd number of additional vertical periods in the first term, the odd number including one.

A display device in accordance with Aspect 5 of the present invention can be configured such that in any one of Aspects 1 to 4, the number of vertical periods in which the refreshing is caused to pause is not less than 0 and not more than 4, between the second vertical period and the additional vertical period.

The additional vertical period may not be necessarily provided immediately after the second vertical period. Note however that the number of pause vertical periods can be not more than 4 between the second vertical period and the additional vertical period. This is intended to shorten an unbalanced-polarity term.

A display device in accordance with Aspect 6 of the present invention can be configured such that in any one of Aspects 1 to 4, the refresh control section sets an initial vertical period in the first term, as the additional vertical period.

As described above, the vertical period immediately after the second vertical period can be set as the additional vertical period.

A display device in accordance with Aspect 7 of the present invention can be configured such that in Aspect 3, in a case where a predetermined number of vertical periods immediately preceding the third vertical period are each the vertical period in which the refreshing is caused to pause, the refresh rate determining section determines that the refresh rate is less than the predetermined value.

The above configuration allows the refresh rate determining section to easily estimate the refresh rate by determining the number of successive pause vertical periods immediately preceding the third period. This can simplify a configuration (resource) and processing of the refresh rate determining section.

A display device in accordance with Aspect 8 of the present invention can be configured such that in Aspect 3, the refresh rate determining section obtains the refresh rate, on the basis of whether or not the refreshing is performed in each of a predetermined number of vertical periods immediately preceding the first term.

The above configuration makes it possible to obtain a more accurate refresh rate. This consequently makes it possible to more appropriately determine the necessity of the additional vertical period.

A display device in accordance with Aspect 9 of the present invention can be configured such that in any one of Aspects 1 to 8, the each pixel has a TFT (thin film transistor) including a semiconductor layer made of an oxide semiconductor.

A display device in accordance with Aspect 10 of the present invention can be configured such that in Aspect 9, the oxide semiconductor is an InGaZnO-based oxide semiconductor.

An electronic apparatus in accordance with Aspect 11 of the present invention includes a display device according to any one of Aspects 1 to 10, the electronic apparatus supplying image data to the display device.

A control method according to Aspect 12 for a display device is a method for controlling a display device in which a polarity of a data signal written in each pixel is reversed depending on whether or not refreshing of a display screen is performed, the method including the steps of: performing the refreshing in each of vertical periods in a term in which an image is rewritten; providing, in a term in which an image is not written, a vertical period in which the refreshing is caused to pause; determining whether or not a first polarity in a second vertical period in which the refreshing is performed is the same as a second polarity in a third vertical period in which the refreshing is caused to pause, the second vertical period immediately preceding a first term in which an image is not rewritten, the third vertical period being a last period in which the refreshing is caused to pause before the second vertical period; and in a case where the first polarity is the same as the second polarity, providing, in the first term, an additional vertical period in which the refreshing is performed by using a polarity opposite to the first polarity.

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention is applicable to a display device and an electronic apparatus including the display device.

REFERENCE SIGNS LIST

1 to 4 display device
10 display section
20, 20*c* display driving section
21 source driver
30, 30*a* display control section
31 image processing section
32 memory
33 TG
34 refresh control section
35 polarity determining section
36 rewriting determining section
37 addition determining section
38 refresh rate determining section
40, 40*b* host control section
41 CPU
42 host memory
43 host TG

The invention claimed is:

1. A display device in which a polarity of a data signal written in each pixel is reversed depending on whether or not refreshing of a display screen is performed, the display device comprising:

a refresh control section for setting vertical periods in each of which an image is rewritten, as vertical periods in each of which the refreshing is performed, and providing, in a term in which an image is not rewritten, a vertical period in which the refreshing is caused to pause; and a polarity determining section for determining whether or not a first polarity in a second vertical period in which the refreshing is performed is the same as a second polarity in a third vertical period in which the refreshing is caused to pause, the second vertical period immediately preceding a first term in which an image is not rewritten, the third vertical period being a last period in which the refreshing is caused to pause before the second vertical period, in a case where the first polarity is the same as the second polarity, the refresh control section providing, in the first term, an additional vertical period in which the refreshing is performed by using a polarity opposite to the first polarity.

2. The display device as set forth in claim 1, wherein the polarity of the data signal written in the each pixel is reversed every time the refreshing is performed.

3. The display device as set forth in claim 2, further comprising:

a refresh rate determining section for determining whether or not a refresh rate is less than a predetermined value, in a case where the refresh rate is less than the predetermined value and the first polarity is the same as the second polarity, the refresh control section providing the additional vertical period in the first term, and in a case where the refresh rate is not less than the predetermined value, the refresh control section providing no additional vertical period in the first term.

4. The display device as set forth in claim 1, wherein the refresh control section provides an odd number of additional vertical periods in the first term, the odd number including one.

5. The display device as set forth in claim 1, wherein the number of vertical periods in which the refreshing is caused to pause is not less than 0 and not more than 4, between the second vertical period and the additional vertical period.

6. The display device as set forth in claim 1, wherein the refresh control section sets an initial vertical period in the first term, as the additional vertical period.

7. The display device as set forth in claim 3, wherein in a case where a predetermined number of vertical periods immediately preceding the third vertical period are each the vertical period in which the refreshing is caused to pause, the refresh rate determining section determines that the refresh rate is less than the predetermined value.

8. The display device as set forth in claim 3, wherein the refresh rate determining section obtains the refresh rate, on the basis of whether or not the refreshing is performed in each of a predetermined number of vertical periods immediately preceding the first term.

9. The display device as set forth in claim 1, wherein the each pixel has a TFT (thin film transistor) including a semiconductor layer made of an oxide semiconductor.

10. The display device as set forth in claim 9, wherein the oxide semiconductor is an InGaZnO-based oxide semiconductor.

11. An electronic apparatus comprising a display device as set forth in claim 1, the electronic apparatus supplying image data to the display device.

12. A method for controlling a display device in which a polarity of a data signal written in each pixel is reversed depending on whether or not refreshing of a display screen is performed, the method comprising the steps of:

performing the refreshing in each of vertical periods in a term in which an image is rewritten;

providing, in a term in which an image is not written, a vertical period in which the refreshing is caused to pause;

determining whether or not a first polarity in a second vertical period in which the refreshing is performed is the same as a second polarity in a third vertical period in which the refreshing is caused to pause, the second vertical period immediately preceding a first term in which an image is not rewritten, the third vertical period being a last period in which the refreshing is caused to pause before the second vertical period; and in a case where the first polarity is the same as the second polarity, providing, in the first term, an additional vertical period in which the refreshing is performed by using a polarity opposite to the first polarity.

* * * * *